United States Patent [19]

Yuzawa

[11] Patent Number: 4,469,066

[45] Date of Patent: Sep. 4, 1984

[54] INJECTION TIMING COMPENSATOR FOR FUEL INJECTION PUMP

[75] Inventor: Yasutaka Yuzawa, Higashi Matsuyama, Japan

[73] Assignee: Diesel Kiki Company, Ltd., Tokyo, Japan

[21] Appl. No.: 375,855

[22] Filed: May 7, 1982

[30] Foreign Application Priority Data

May 14, 1981 [JP] Japan ..... 56-68624[U]

[51] Int. Cl.³ ..... F02M 59/20

[52] U.S. Cl. ..... 123/380; 123/383; 123/502

[58] Field of Search ..... 123/380, 383, 501, 502, 123/503; 417/289, 278, 462

[56] References Cited

U.S. PATENT DOCUMENTS

| | | | |
|---|---|---|---|
| 2,008,143 | 7/1935 | Mock | 123/380 |
| 3,726,263 | 4/1973 | Kemp | 123/383 |
| 4,308,834 | 1/1982 | Eheim | 123/383 |
| 4,384,560 | 5/1983 | Jager et al. | 123/383 |
| 4,387,683 | 6/1983 | Eheim | 123/502 |

FOREIGN PATENT DOCUMENTS

| | | | |
|---|---|---|---|
| 41429 | 4/1981 | Japan | 123/383 |

*Primary Examiner*—Magdalen Y. C. Moy

*Attorney, Agent, or Firm*—Jordan and Hamburg

[57] ABSTRACT

A pressure sensitive member (68) is operatively connected to a pressure regulator assembly (80, 100) through a cam section (64*b*) of a control pin (64) and a follower pin (76). The pressure regulator assembly (80, 100) regulates a fuel pressure inside a chamber (12*a*) of a pump housing (12) upon a change of a pressure acting on the pressure sensitive member (68), thereby compensating a timing of fuel injection determined by an injection timing control member (24). The pressure acting on the pressure sensitive member (68) is an atmospheric pressure or a boost pressure. The pressure regulator (80, 100) is adjustable to either advance or retard the injection timing as desired in conformity with an atmospheric pressure or a boost pressure, or to vary the point at which the fuel pressure in the pump chamber (12*a*) starts to be varied.

5 Claims, 5 Drawing Figures

INJECTION TIMING COMPENSATOR FOR FUEL INJECTION PUMP

BACKGROUND OF THE INVENTION

The present invention relates to a fuel injection pump which may be, but is not limited to, the distribution type and, more particularly, to an apparatus for compensating a fuel injection timing of such a pump.

Where an internal combustion engine, particularly a diesel engine, designed for use at ordinary low altitudes is operated at high altitudes as during uphill climbing of a motor vehicle, an excessive supply of fuel occurs due to the thin air and this not only deteriorates the fuel economy but causes emission of smoke resulting in environmental pollution. It is therefore necessary to compensate the fuel injection both in quantity and timing in accordance with a variation in air density originating from a change of atmospheric pressure.

A current tendency in the art of internal combustion engines is to the use of turbochargers or like superchargers for increasing the engine output power and enhancing the fuel economy. In an engine with a supercharger, the injection quantity must be adjusted to match with an amount of intake air fed to each engine cylinder by the supercharger, while the injection timing must be controlled in relation with, for example, the output and thermal load of the engine.

Heretofore, an apparatus for compensating the quantity of fuel injection has been proposed as typified by an atmospheric pressure compensator or a boost compensator. However, an apparatus capable of varying the timing of fuel injection in accordance with the atmospheric pressure or the boost pressure has been unknown to the art.

SUMMARY OF THE INVENTION

In a fuel injection pump which includes an engine driven feed pump supplying fuel under pressure to a chamber defined inside a housing of the pump, a fuel injection timing control member operated by an output fuel pressure of the feed pump in accordance with an engine speed, and a fuel control member, an injection timing compensating apparatus embodying the present invention is characterized by comprising a pressure regulator means for regulating a fuel pressure in the chamber of the housing by controlling fluid communication between the chamber and a low pressure side associated with the pump, and pressure sensitive actuator means for actuating the pressure regulator means through an operative connection in accordance with a pressure acting thereon, whereby an injection timing determined by the fuel injection timing control member is compensated in conformity with a level of the pressure acting on the actuator means through the injection timing control member.

In accordance with the present invention, a pressure sensitive member is operatively connected to a pressure regulator assembly through a cam section of a control pin and a follower pin. The pressure regulator assembly regulates a fluid pressure inside a chamber of a pump housing upon a change of a pressure acting on the pressure sensitive member, thereby compensating an injection timing determined by an injection timing control member. The pressure acting on the pressure sensitive member is an atmospheric pressure or a boost pressure. The pressure regulator is adjustable to either advance or retard the injection timing as desired in conformity with an atmospheric pressure or a boost pressure, or to vary the point at which the fuel pressure in the pump chamber starts to be varied.

It is an object of the present invention to provide a new injection timing compensator for a fuel injection pump of the type described which allows the timing of fuel injection to be automatically adjusted in conformity with an atmospheric pressure or a boost pressure.

It is another object of the present invention to provide an injection timing compensator for a fuel injection pump of the type described which can compensate the injection timing in an adjustable manner.

It is another object of the present invention to provide a simple yet efficient injection timing compensator which does not affect the construction of a fuel control mechanism.

Other objects, together with the foregoing, are attained in the embodiment described in the following description and illustrated in the accompanying drawing.

DESCRIPTION OF THE PREFERRED EMBODIMENTS

While the injection timing control device for a fuel injection pump of the present invention is susceptible of numerous physical embodiments, depending upon the environment and requirements of use, substantial numbers of the herein shown and described embodiments have been made, tested and used, and all have performed in an eminently satisfactory manner.

Figure 1:
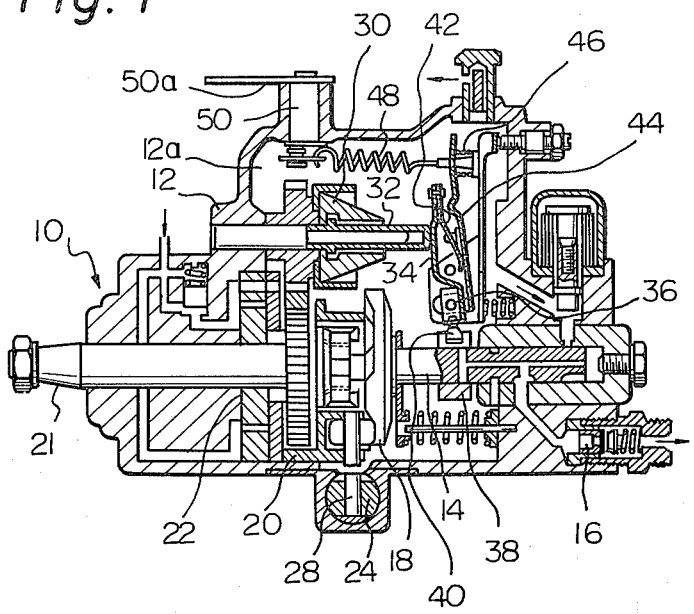
FIG. 1 is a vertical section of a fuel injection pump to which the present invention is applicable.
Figure 2:
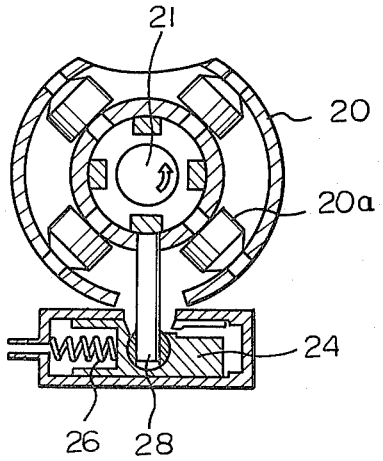
FIG. 2 is a fragmentary horizontal section of the fuel injection pump shown in FIG. 1.

Referring now to FIGS. 1 and 2 of the drawing, a distribution type fuel injection pump to which the present invention is applicable is generally designated by the reference numeral 10 and comprises a housing 12. A plunger or piston 14 distributes a controlled volume of fuel under pressure to each cylinder of a multicylinder internal combustion engine through a delivery valve 16. To so function, the plunger 14 is rotated about its axis by a cam disc 18 and, at the same time, reciprocated along its axis due to sliding contact of a cam surface of the cam disc 18 with rollers 20*a* carried on a roller holder 20. The cam disc 18 is operatively connected with an input shaft 21 which is in turn driven by the engine.

The housing 12 has therein a chamber 12*a* into which fuel to be pumped by the plunger 14 is fed by a feed pump 22. The amount of fuel supply to the chamber 12*a* varies in accordance with the operating speed of the engine. A part of the fuel is introduced into a timer assembly (not designated) located at the bottom of the housing 12. The timer comprises a timer piston 24 and a timer spring 26 and is connected to the roller holder 20 by a rod 28, as shown in detail in FIG. 2. The timer piston 24 is displacable in response to the input fuel pressure against the action of the timer spring 26.

The fuel pressure generated by the feed pump 22 moves the timer piston 24 in the timer which in turn angularly moves the roller holder 20. This varies the relative contact position between the rollers 20*a* and the cam surface of the cam disc 18 and, therefore, the relation between the circumferential phase of the input shaft 21 and the operating position of the plunger 14, whereby the injection timing of fuel from the pump is controlled. In the illustrated type of pump 10, the injection timing will be advanced when the timer piston 24 is shifted to the left against the timer spring 26 as viewed in FIG. 2.

Flyweights 30 are rotatably driven by the input shaft 21. Rotation of the flyweights 30 causes a governor rod or shaft 32 to be moved relative to the housing 12 to an extent which depends on the engine speed. A start lever 34 is rotatably mounted on a pin 36 which is studded on the housing 12. A control sleeve 38 is slidable on the plunger 14 and is formed with a recess (not designated) in which a pin 40 on one end of the start lever 34 is engaged. A start spring 42 is secured to the other end of the start lever 34 to cause it into constant engagement with the end of the governor rod 12. Also rotatably mounted on the pin 36 is a tension lever 44 which, while serving to hold the start spring 42, is rotatable about the pin 36 together with the start lever 34 in unison with the movement of the governor rod 32. The tension lever 44 is urged by an idling spring 46 and a governor spring 48. The governor spring 48 is anchored at the other end to a shaft 50 on a control lever 50*a* which may be operatively connected to the accelerator pedal of a motor vehicle. When the control lever 50*a* is in a start position or a maximum engine speed position, the governor spring 48 will pull the tension lever 44 until the latter becomes engaged with a full load stop (not shown) on the housing 12. The force of the governor spring 48 is intenser than that of the idling spring 46 which is intenser than that of the start spring 42. The start lever 34 or the tension lever 44 is rotated to move the control sleeve 38 along its axis through the pin 40 thereby controlling the amount of fuel injection from the pump 10. Under full load condition, the position of the full load stop is adjustable to control the operating position of the tension lever 44 and thereby the amount of fuel injection.

Figure 3:
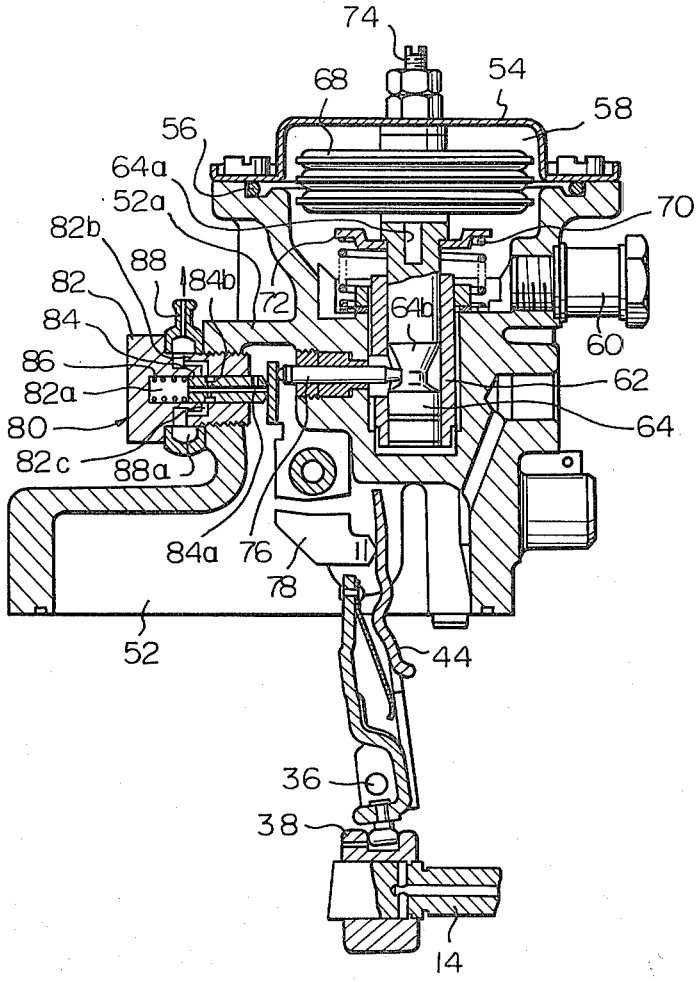
FIG. 3 is a vertical section of an injection timing compensator embodying the present invention.

Referring to FIG. 3, an apparatus embodying the present invention which controls fuel injection both in quantity and timing in accordance with an atmospheric pressure is shown. The apparatus comprises a housing 52 which is mounted fluid-tight to the top of the pump housing 12. A cover 54 is mounted on top of the housing 52 through an O-ring 56 to define a control chamber 58. The control chamber 58 is communicated to the atmosphere via an atmospheric port 60 while being fluidly isolated from the pump chamber 12*a* by an intermediate section 52*a* of the housing 52.

A sleeve 62 is fixedly received in the intermediate housing section 52*a* and a control pin or plunger 64 is slidable axially within the sleeve 62. A metal bellows or like pressure sensitive member 68 is disposed in the control chamber 58. A rod extending from the bellows 68 is received in a bore 64*a* which is formed at the upper end of the control pin 64. A spring 70 is loaded between the bottom of the control chamber 58 defined by the housing section 52*a* and a spring seat 72 mounted on the control pin 64. The spring 70 constantly urges the rod of the bellows 68 upwardly so that the top of the rod remains in abutting engagement with an adjusting screw 74, which is threaded into the cover 54. Position of the adjusting screw 74 sets axial inoperative position of the control pin 64. The bellows 68 is expansible in response to a change in the atmospheric pressure communicated thereto, whereby the axial position of the control pin 64 is variable. The interior of the bellows 68 is made vacuous to allow a change of atmospheric pressure to be readily sensed and minimize temperature variation.

The control pin 64 is partly tapered downwardly as at 64*b*. A follower pin 76 extends throughout the intermediate housing section 52*a* to be movable transversely in engagement with the tapered portion or cam portion 64*b* at one end thereof. The other end of the follower pin 76 abuts against one surface of a lever 78 which is pivotally mounted to the housing 52. The lever 78 is constantly engaged by one end of the tension lever 44 the other end of which, as previously mentioned, connects to the control sleeve 38.

A pressure regulator assembly generally designated by the reference numeral 80 comprises a body 82 having a bore 82*a* thereinside, a valve member 84 slidably disposed in the bore 82*a* and a spring 86 interposed between the body 82 and the valve member 84 inside the bore 82*a*. The body 82 is threaded into the housing 52 below the intermediate housing section 52*a* with a connector 88 interposed therebetween. The connector 88 is shaped to define an annular chamber 88*a* in cooperation with the body 82 and is in fluid communication with a fuel reservoir or like low pressure side (not shown). The body 82 is formed with two passageways 82*b* and 82*c* each open to the annular chamber 88*a* at one end and the bore 82*a* at the other end. The valve member 84 is formed with an axial passageway 84*a* which is communicated with the pump chamber 12*a* and bore 82*a* at opposite ends, and two radial passageways 84*b* extending from the axial passageway 84*a* to the outer periphery of the member 84. The axial passageway 84*a* extends throughout the valve member 84 so that a high pressure will be communicated into the bore 82*a* to maintain a pressure balance. The valve member 84 constantly abuts against the other side of the lever 78. A normal or inoperative position of the valve member 84 is such that the radial passageways 84*b* thereof are communicated with the passageways 82*b* and 82*c* of the body 82, respectively. In such a position of the valve member 84, that is, as long as the apparatus is not activated, the fluid under pressure inside the pump chamber 12*a* overflows to the low pressure source via the valve member 84, body 82 and connector 88.

In operation, suppose that a motor vehicle with the device having the above construction has reached a high altitude as during uphill climbing by way of example. Then, a drop of the atmospheric pressure causes the bellows 68 to expand to urge the control pin 64 downwardly, whereby the follower pin 76 is cammed to the left as viewed in FIG. 3 by the tapered portion 64*b* of the control pin 64. The follower pin 76 in turn urges the lever 78 counterclockwise as viewed in FIG. 3 so that the tension lever 44 is rotated clockwise about the pin 36 to move the control sleeve axially to the left, i.e. in the fuel reducing direction. As a result, the amount of fuel injection from the pump 10 is reduced in proportion to the rate of decrease in air density.

Meanwhile, the follower pin 76 moving to the left urges the valve member 84 of the pressure regulator 80 progressively to the left through the lever 78 against the action of the spring 86. Then, the radial passageways 84b are displaced across their corresponding passageways 82b and 82c until they become stopped up by the inner wall of the bore 82a of the body 82. This cuts off the overflow of the pressurized fuel from the pump chamber 12a to the low pressure side so that the fuel pressure inside the pump chamber 12a, therefore the fuel pressure acting on the timer piston 24, is progressively increased. Consequently, the timer piston 24 is urged to the left as viewed in FIG. 2 against the force of the timer spring 26 rotating the roller holder 20 in a direction for advancing the injection timing. Thus, the timing of fuel injection from the pump 10 is advanced in accordance with the drop of the atmospheric pressure. This constitutes an effective measure against an increase in the emission of toxic hydrocarbons due to a decrease in air density.

Figure 4:
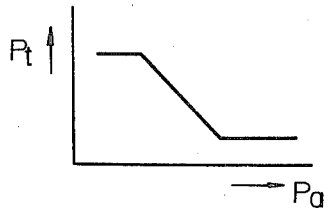
FIG. 4 is a graph showing an injection timing advance characteristic attainable with the injection timing compensator of the present invention.

Such an injection timing advance characteristic is represented by a curve in FIG. 4, in which the ordinate indicates a fuel pressure Pt inside the pump chamber 12a and the abscissa an atmospheric pressure Pa. It will be seen that a desired injection timing advance characteristic matching with an atmospheric pressure is attainable by suitably designing the cross-sectional areas of the passageways in the body 82, those of the radial passageways in the valve member 84, etc.

The construction and arrangement shown in FIG. 3 may be modified to increase the amount of fuel injection and advance the injection timing in accordance with a boost pressure. In such a modification, the bellows 68 is replaced by a known diaphragm actuator and a boost pressure is communicated to the actuator via the port 60. Displacement of the diaphragm caused by a boost pressure will rotate the tension lever 44 counterclockwise this time. As in the illustrated embodiment, the pressure regulator 80 is constructed to close the radial passageways 84b of the valve member 84 simultaneously with the actuation of the tension lever 44. Under these modified conditions, if the valve member 84 is positioned such that its radial passageways 84b are normally closed but become opened upon displacement of the diaphragm, the injection timing can be retarded when the atmospheric pressure drops and advanced when it rises as may be required by the engine, in the opposite relation to the aforementioned.

Figure 5:
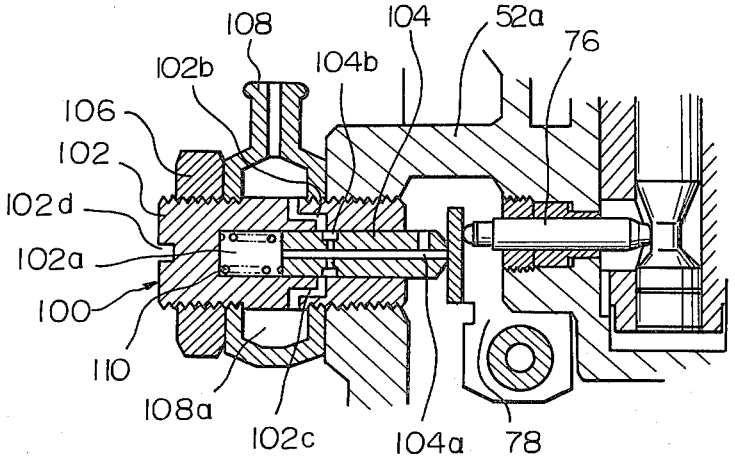
FIG. 5 is a fragmentary vertical section showing another embodiment of the present invention.

Referring to FIG. 5, there is shown another embodiment of the present invention. In FIG. 5, a pressure regulator assembly 100 has a body 102 which is axially adjustable relative to a valve member 104. The body 102 is threaded at its opposite ends and screwed into the intermediate housing section 52a at one of the threaded ends. A lock nut 106 is in threaded engagement with the other end of the body 102 for securing a connector 108 to the housing 52. The outermost end of the body 102 is formed with a groove 102d in which a screw driver or like tool can be engaged. The body is formed with two passageways 102b and 102c each communicating with a bore 102a and an annular chamber 108a. The valve member 104 is slidably received in the bore 102a and constantly biased by a spring 110 outwardly of the bore 102a.

In the pressure regulator 100, the body 102 is axially movable to a desired position relative to the valve member 104 by loosening the lock nut 106 and then rotating the body 102 about its axis. The desired position may be such that in the normal or inoperative position of the follower pin 76 radial passageways 104b in the valve member 104 are communicated with the passageways 102b and 102c in the body 102 or, conversely, such that in the same position of the pin 76 the radial passageways 102b are discommunicated from the passageways 102b and 102c. Additionally, the radial passageways 104b can start communicating with or discommunicating from the passageways 102b and 102c at a desired level of atmospheric pressure or boost pressure. This timing corresponds to a point of the Pt-Pa curve of FIG. 4 at which the pressure Pt in the pump chamber 12a starts varying.

While the pressure regulator 80 in FIG. 3 or 100 in FIG. 5 is constructed to transmit the movement of the follower pin 76 to its associated members through the lever 78, the illustrated position of the pressure regulator adjacent the lever 78 is not limitative. For instance, a sensor pin independent of the follower pin 34 may be located in a position which is at an angular distance of 90° horizontally from the position shown in FIG. 3, so that the valve member 84 will directly abut against the sensor pin.

In summary, it will be seen that the present invention realizes a simple yet efficient construction and arrangement which permits the timing of fuel injection to be adjusted in various ways in accordance with an atmospheric pressure or a boost pressure without affecting the construction and operation of a fuel control mechanism.

What is claimed is:

1. An injection timing compensating apparatus for a fuel injection pump which includes an engine driven feed pump supplying fuel under pressure to a chamber defined inside a housing of the injection pump, an injection timing control member operated by an output fuel pressure of the feed pump in accordance with an engine speed, and a fuel control member, characterized by comprising:

a pressure regulator means for regulating a fuel pressure in the chamber of the injection pump housing by controlling fluid communication between the chamber and a low pressure side associated with the injection pump; and a pressure sensitive actuator means for actuating the pressure regulator means through an operative connection in accordance with a pressure acting thereon;

whereby a timing a fuel injection determined by the fuel injection timing control member is compensated through the injection timing control member in confirmity with a level of the pressure acting on the actuator means;

the operative connection between the pressure regulator means and the pressure sensitive actuator means comprising a vertically reciprocatable control pin which is partly tapered to form a cam section and a follower pin cammed by said cam section transversely relative to the control pin, the pressure regulator means including a body mounted to a housing of the apparatus, a valve member slidably disposed in a bore of the body and a spring biasing the valve member outwardly of the body, each of said body and valve member being provided with passageway means for selective communication of the pump chamber with the low pressure side, the control pin being integrally connected with the pressure sensitive actuator means while the follower pin is positioned to urge the valve member against the action of the spring.

2. An apparatus as claimed in claim 1, in which the pressure acting on the pressure sensitive actuator means is an atmospheric pressure, the actuator means comprising a bellows made of metal.

3. An apparatus as claimed in claim 1, in which the pressure acting on the pressure sensitive actuator means is a boost pressure, the actuator means comprising a diaphragm member.

4. An apparatus as claimed in claim 1, in which the pressure regulator means includes a body mounted to a housing of the apparatus and a spring biased valve member slidably disposed in a bore of the body, each of said body and valve member being provided with passageway means for selective communication of the pump chamber with the low pressure side.

5. An apparatus as claimed in claim 4, in which the body is adjustable in position relative to the valve member.

* * * * *